US008331815B2

(12) United States Patent
Nishikawa

(10) Patent No.: US 8,331,815 B2
(45) Date of Patent: Dec. 11, 2012

(54) IMAGE FORMING APPARATUS, IMAGE FORMING SYSTEM, AND PROGRAM

(75) Inventor: Naoki Nishikawa, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 309 days.

(21) Appl. No.: 12/732,936

(22) Filed: Mar. 26, 2010

(65) Prior Publication Data

US 2010/0303491 A1 Dec. 2, 2010

(30) Foreign Application Priority Data

May 29, 2009 (JP) ..... 2009-130340

(51) Int. Cl.
*G03G 15/08* (2006.01)

(52) U.S. Cl. ..... 399/53; 399/24; 399/27; 399/61; 399/401

(58) Field of Classification Search ..... 399/24, 399/27, 53, 61, 401
See application file for complete search history.

(56) References Cited

U.S. PATENT DOCUMENTS

| | | | |
|---|---|---|---|
| 2001/0021031 A1 | 9/2001 | Hashimoto et al. | |
| 2005/0207767 A1 | 9/2005 | Imayoshi et al. | |
| 2008/0240826 A1 | 10/2008 | Shen | |
| 2008/0260396 A1 | 10/2008 | Yamada | |
| 2010/0302561 A1* | 12/2010 | Nishikawa | 358/1.9 |

FOREIGN PATENT DOCUMENTS

| | | |
|---|---|---|
| JP | 6-24050 A | 2/1994 |
| JP | 7-152287 A | 6/1995 |
| JP | 7-246739 A | 9/1995 |
| JP | 8-52907 A | 2/1996 |
| JP | 9-244388 A | 9/1997 |
| JP | 9-244510 A | 9/1997 |
| JP | 11-133678 A | 5/1999 |
| JP | 11-284818 A | 10/1999 |
| JP | 2004-347627 A | 12/2004 |
| JP | 2005-017828 A | 1/2005 |
| JP | 2005-91905 | 4/2005 |
| JP | 2005-182246 A | 7/2005 |
| JP | 2008-139696 A | 6/2008 |
| JP | 2009-001000 A | 1/2009 |
| JP | 2009-086578 A | 4/2009 |
| JP | 2009-093121 A | 4/2009 |

OTHER PUBLICATIONS

Japanese Official Action dated Apr. 19, 2011 together with English language translation from JP 2009-130340.
Extended European Search Report dated Nov. 18, 2011 from related European Application No. 10003300.0.
Chinese Official Action dated May 2, 2012 received from the Chinese Patent Office from application No. 201010144120.0 and English language translation thereof.

* cited by examiner

*Primary Examiner* — Ryan Walsh
(74) *Attorney, Agent, or Firm* — Scully, Scott, Murphy & Presser, PC

(57) ABSTRACT

An image forming apparatus determines whether an amount of colorant remaining in a container is equal to or greater than a threshold value and controls a print unit to perform a reduced printing operation with a reduced amount of colorant if the amount of the remaining colorant is less than the threshold value is made and to perform the reduced printing operation on one side of a new non-printed sheet instead of performing the reduced printing operation on the opposite side of a one-side printed sheet existing if the amount of the remaining colorant is less than the threshold value.

12 Claims, 6 Drawing Sheets

IMAGE FORMING APPARATUS, IMAGE FORMING SYSTEM, AND PROGRAM

CROSS REFERENCE TO RELATED APPLICATION

The present application claims priority from Japanese Patent Application No. 2009-130340, which was filed on May 29, 2009, the disclosure of which is incorporated herein by reference in its entirety.

BACKGROUND

The present invention relates to an image forming apparatus, an image forming system, and a program, which have a double-side printing function.

As a double-side printing method of a printing apparatus, a method (hereinafter, referred to as "double-side continuous printing method") of continuously performing a one-side printing operation and an opposite-side printing operation on a sheet consistently from start to end of a printing process is well-known. In contrast, there is a printing apparatus employing a method (hereinafter, referred to as "one-side continuous printing method") including a process of performing a one-side printing operation on a sheet between a one-side printing operation and an opposite-side printing operation on another sheet, in other words, continuously performing the one-side printing operation on plural sheets. In the one-side continuous printing method, since a sheet inversion time between the printing on one side of a sheet and the printing on the opposite side of the sheet is allocated to a printing operation on another sheet, the printing process can be performed faster than that in the double-side continuous printing method by an according amount.

SUMMARY

However, in the one-side continuous printing method, as described above, the one-side printing operation is performed on other sheets between the printing on one side of a sheet and the printing on the opposite side of the sheet. Accordingly, when a colorant is deficient in the course of performing the double-side printing operation and the double-side printing operation is successively performed simply by reducing the amount of colorant to be used at that time, a problem may occur that unsuitable sheets in which images having different tones are printed on one side and the opposite side thereof are generated more than those in the double-side continuous printing method.

The invention is made in view of the above-mentioned problem, and an object thereof is to provide an image forming apparatus, an image forming system, and a program which can suppress the problem that unsuitable sheets (including sheets of paper) are generated due to a lack of a colorant.

According to an exemplary embodiment of the invention, there is provided an image forming apparatus comprising:

a print unit which includes a container containing a colorant and performs a double-side printing operation including an operation of printing images on one side of N non-printed sheets ($N \geqq 1$) and then printing images on the opposite side of M one-side printed sheets ($M \leqq N$) using the colorant;

a determination unit which determines whether an amount of the colorant remaining in the container is equal to or greater than a threshold value; and a control unit which causes the print unit to perform a reduced printing operation with a reduced amount of colorant when the determination unit determines that the amount of the remaining colorant is less than the threshold value, wherein the control unit performs the reduced printing operation on one side of a new non-printed sheet instead of performing the reduced printing operation on the opposite side of a one-side printed sheet existing at the time that the determination unit determines that the amount of the remaining colorant is less than the threshold value.

According to the exemplary embodiment of the invention, there is provided an image forming system comprising:

a conveyance mechanism conveying a non-printed sheet;

a print unit which includes a container containing a colorant and performs a double-side printing operation including an operation of printing images on one side of N non-printed sheets ($N \geqq 1$) and then printing images on the opposite side of M one-side printed sheets ($M \leqq N$) using the colorant;

a determination unit which determines whether an amount of the colorant remaining in the container is equal to or greater than a threshold value; and a control unit which causes the print unit to perform a reduced printing operation with a reduced amount of colorant when the determination unit determines that the amount of the remaining colorant is less than the threshold value, wherein the control unit performs the reduced printing operation on one side of a new non-printed sheet instead of performing the reduced printing operation on the opposite side of a one-side printed sheet existing at the time that the determination unit determines that the amount of the remaining colorant is less than the threshold value.

According to the exemplary embodiment of the invention, there is provided a computer readable recording medium storing a program controlling an image forming apparatus which includes a print unit which includes a container containing a colorant and performs a double-side printing operation including an operation of printing images on one side of N non-printed sheets ($N \geqq 1$) and then printing images on the opposite side of M one-side printed sheets ($M \leqq N$) using the colorant, the program causing the image forming apparatus to perform:

determining whether an amount of the colorant remaining in the container is equal to or greater than a threshold value; and causing the print unit to perform a reduced printing operation with a reduced amount of colorant when it is determined that the amount of the remaining colorant is less than the threshold value in such a manner that the reduced printing operation is performed on one side of a new non-printed sheet instead of performing the reduced printing operation on the opposite side of a one-side printed sheet existing at the time that it is determined that the amount of the remaining colorant is less than the threshold value.

According to the exemplary embodiment of the invention, there is provided an image forming apparatus comprising:

a print unit which includes a container containing a colorant and performs a double-side printing operation using the colorant, the double-side printing operation including an operation of printing images on a first side of a sheet and then printing images on a second side of the sheet;

a determination unit which determines whether an amount of the colorant remaining in the container is equal to or greater than a threshold value; and a control unit which causes the print unit to perform a normal printing operation and a reduced printing operation using an amount of colorant smaller than that of the normal printing operation, wherein when the determination unit determines that the amount of the remaining colorant is equal to or greater than the threshold value, the control unit causes the print unit to perform the normal printing operation, wherein when the determination unit determines that the amount of the remaining colorant is less than the threshold value, the control unit performs the reduced printing operation on a first side of a new non-printed sheet, wherein if the determination unit determines that the amount of the remaining colorant is less than the threshold value, the control unit performs the normal printing operation on the second side of a sheet whose first side is printed in the normal printing operation, and wherein if the determination unit determines that the amount of the remaining colorant is less than the threshold value, the control unit performs the reduced printing operation on one side of a second side of the sheet whose first side is printed in the reduced printing operation.

According to the above-mentioned invention, it is possible to suppress a problem that unsuitable sheets are generated due to the lack of a colorant.

DESCRIPTION OF EXEMPLARY EMBODIMENTS

An embodiment of the invention will be described with reference to the accompanying drawings.

1. Electrical Configuration of Image Forming System

Figure 1:
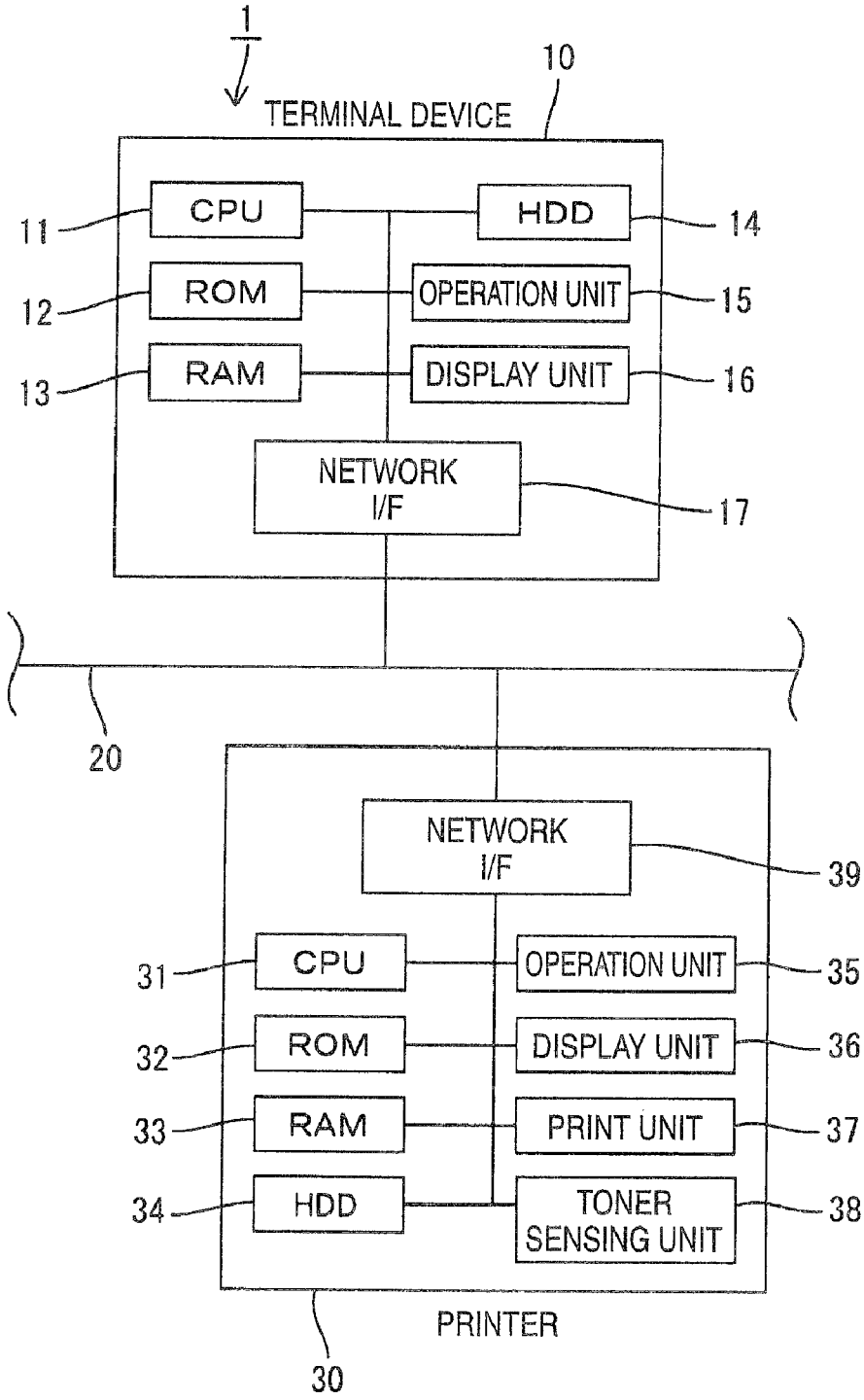
FIG. 1 is a block diagram illustrating an electrical configuration of an image forming system according to an embodiment of the invention.

FIG. 1 is a block diagram illustrating an electrical configuration of an image forming system according to the embodiment. The image forming system 1 includes a terminal device 10 (such as a personal computer which is an example of an information processing apparatus) and a printer 30 (which is an example of an image forming apparatus).

The terminal device 10 includes a CPU 11, a ROM 12, a RAM 13, a hard disk driver 14, an operation unit 15 including a keyboard or a pointing device, a display unit 16 including a liquid crystal display, and a network interface 17 connected to a communication line 20. Various programs such as OS, application software for preparing print data, and a printer driver for controlling the printer 30 are stored in the hard disk drive 14.

The printer 30 includes a CPU 31 (example of the determination unit and the control unit), a ROM 32, a RAM 33, a hard disk drive 34, an operation unit 35, a display unit 36, a print unit 37, a toner sensing unit 38, and a network interface 39. Various programs for controlling the operation of the printer 30 and a double-side printing control program for performing a double-side printing process are stored in the ROM 32. The CPU 31 stores the process results in the RAM 33 and controls the operation of the printer 30 in accordance with the program read from the ROM 32.

The operation unit 35 includes plural buttons and can be subjected to various input operations such as a print start instruction by a user. The display unit 36 includes a liquid crystal display and a lamp and can display various setting pictures and operation states. The print unit 37 prints an image based on image data on a sheet W (such as a sheet of paper and an OHP sheet). The network interface 39 is connected to an external terminal device 10 via the communication line 20 and can perform data communication therewith. The toner sensing unit 38 will be described later.

2. Inner Configuration of Printer

Figure 2:
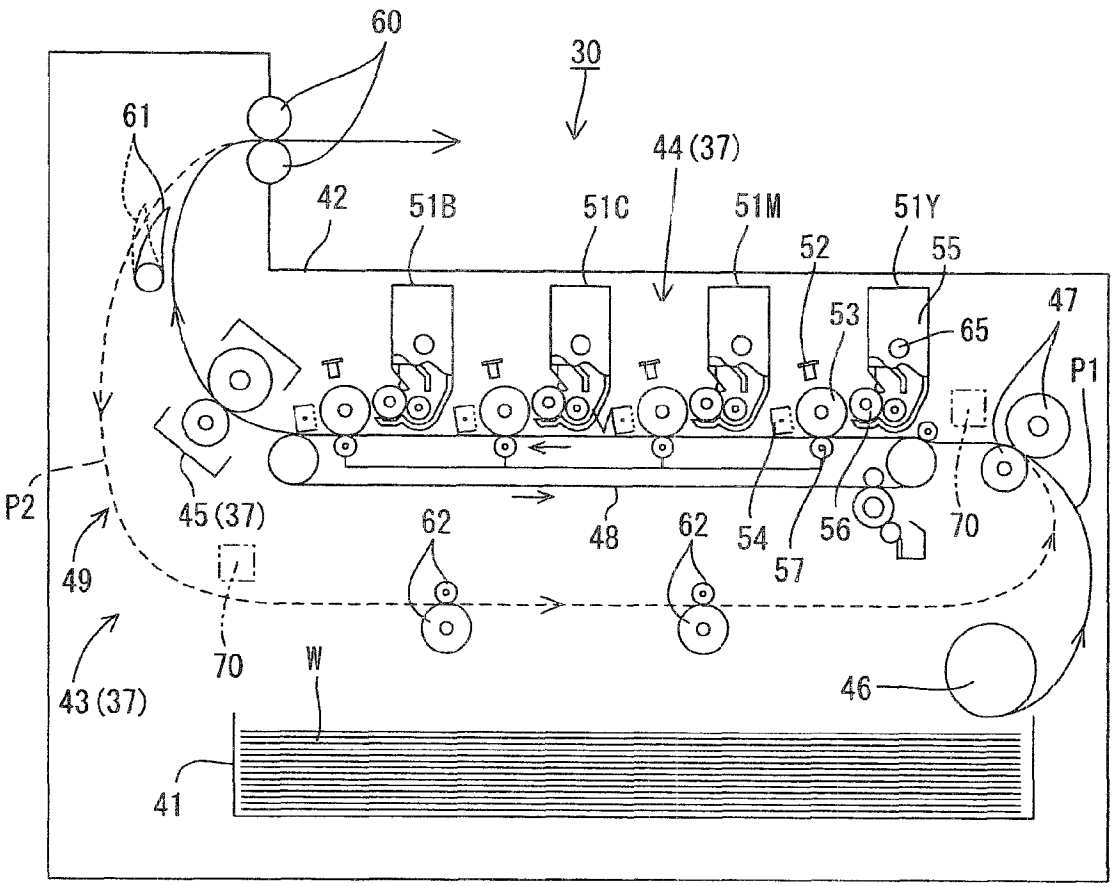
FIG. 2 is a diagram schematically illustrating an inner configuration of a printer.

FIG. 2 is a diagram schematically illustrating the inner configuration of the printer 30. In the following description, when elements are distinguished by colors, subscripts of Y (yellow), M (magenta), C (cyan), and B (black) are added to the reference numerals of the elements. When the elements are not distinguished, the subscripts are not added.

The printer 30 includes a feed tray 41, the print unit 37, and a discharge tray 42. The feed tray 41 is disposed at the bottom of the printer 30 and can receive plural sheets W.

The print unit 37 includes a conveyance mechanism 43, a process unit 44, and a fixing unit 45. The conveyance mechanism 43 includes a pickup roller 46, registration rollers 47 and 47, a sheet conveying belt 48, and an inversion mechanism 49. The pickup roller 46 picks up a sheet W received in the feed tray 41 and conveys the sheet to the registration rollers 47 and 47. The registration rollers 47 and 47 arrange the conveyed sheet W and send the sheet onto the belt 48 at a predetermined time.

The process unit 44 includes plural (for example, four) process cartridges 51Y, 51M, 51C, and 51B and plural (for example, four) exposure devices 52 corresponding to plural (for example, four) color toners (an example of the colorant). Each process cartridge 51 includes a photosensitive member 53, a charger 54, and a toner container 55 (an example of the container).

The charger 54 is a so-called scorotron type charge and uniformly electrifies the surface of the photosensitive member 53. The exposure device 52 includes plural light-emitting devices (such as LED) arranged in a line along the rotation axis of the photosensitive member 53 and forms an electrostatic image on the surface of the photosensitive member 53 by controlling the light emission of the plural light-emitting devices on the basis of image data by the colors.

The toner container 55 contains the color toners (for example, positively-charged nonmagnetic single-component toners in this embodiment) and includes a developing roller 56. The developing roller 56 charges the toner to "+" (positive polarity) and supplies the toner as a uniform thin layer to the photosensitive member 53, whereby the electrostatic latent image is developed to form a toner image (monochromatic or color image).

Each transfer roller 57 is disposed at a position interposing the belt 48 in cooperation with the corresponding photosensitive member 53. Each transfer roller 57 is supplied with a transfer voltage having the opposite polarity of the polarity of the charged toner on the photosensitive member 53 and transfers the toner image formed on the photosensitive drum 53 to the sheet W. Thereafter, the sheet W is conveyed to the fixing unit 45 by the conveyance mechanism 43, the toner image is thermally fixed by the fixing unit 45, and the resultant sheet is discharged to the discharge tray 42. The path (indicated by a solid arrow in FIG. 2) for guiding the sheet W from the feed tray 41 onto the belt 48 (print area) is called a printing conveyance path P1.

The inversion mechanism 49 includes a discharge roller 60, an inverse conveyance path P2 (indicated by a dotted arrow in FIG. 2), a flapper 61, and plural inverse conveyance rollers 62. For example, when a double-side printing operation is performed using the double-side continuous printing method, an image is printed on the back side (the bottom surface when the sheet is received in the feed tray 41) of the sheet W by the process unit 44 and the sheet is then conveyed once by the discharge roller 60.

Then, the sheet W is conveyed via the flapper 61, the inverse conveyance path P2, the inverse conveyance rollers 62, and the registration rollers 47 with the inverse rotation of the discharge roller 60, and is then sent out onto the belt 48 with the front and rear surfaces inverted. Then, an image is printed on the front surface (the top surface when the sheet is received in the feed tray 41) of the sheet W by the process unit 44 and is discharged onto the discharge tray 42.

The toner sensing unit 38 senses individually the amounts of remaining toners in the toner containers 55 of the process cartridges 51. Specifically, both side walls of each process cartridge 51 are provided with a light-transmitting window and the toner sensing unit 38 includes four sensors 65 corresponding to the four process cartridges 51.

Each sensor 65 includes a light-emitting element and a light-receiving element arranged oppositely so as to interpose the light-transmitting window of the corresponding process cartridge 51 therebetween. The light from the light-emitting element is received through the light-transmitting window by the light-receiving element and the light intensity received by the light-receiving element varies depending on the amount of remaining toner of the corresponding toner container 55. Accordingly, by causing the toner sensing unit 38 to give light-reception signals corresponding to the light intensity received by the light-receiving elements to the CPU 31, the CPU 31 can individually acquire the amounts of remaining toner in the process cartridges 51.

3. Method of Performing Double-side Printing Process

Figure 3A:
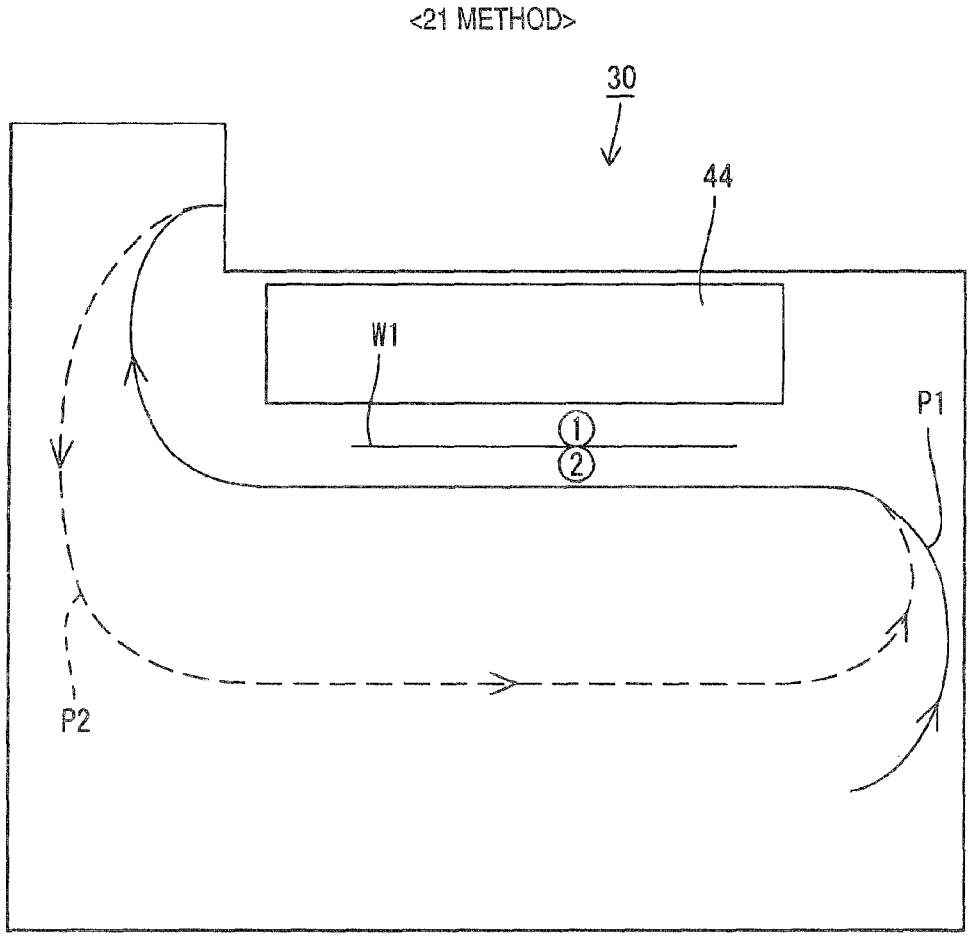
FIG. 3A is a diagram schematically illustrating a 21 method.
Figure 3B:
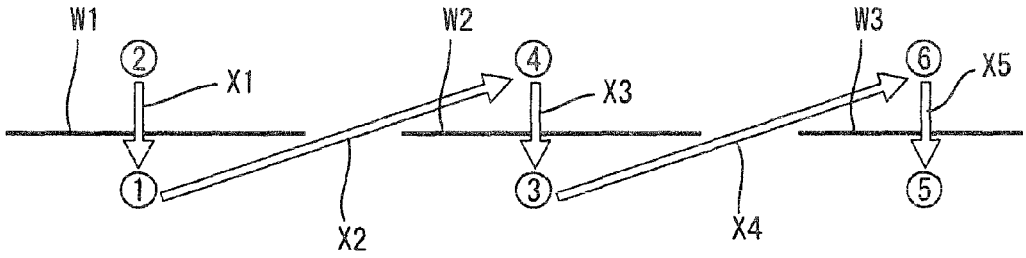
FIG. 3B is a diagram illustrating a printing sequence in the 21 method.
Figure 4A:
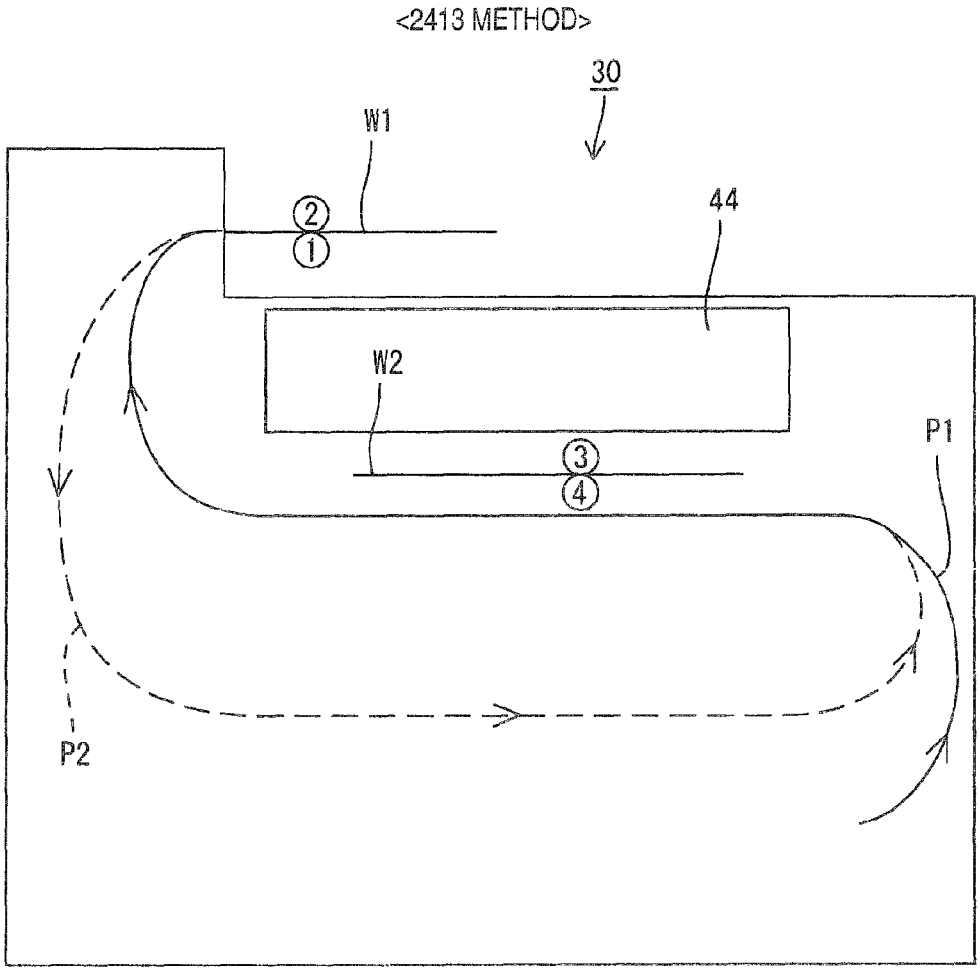
FIG. 4A is a diagram schematically illustrating a 2413 method.
Figure 4B:
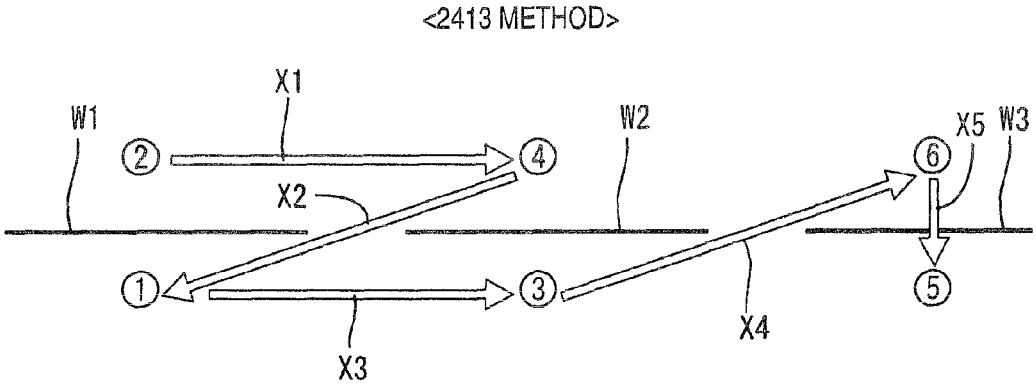
FIG. 4B is a diagram illustrating a printing sequence in the 2413 method.
Figure 5A:
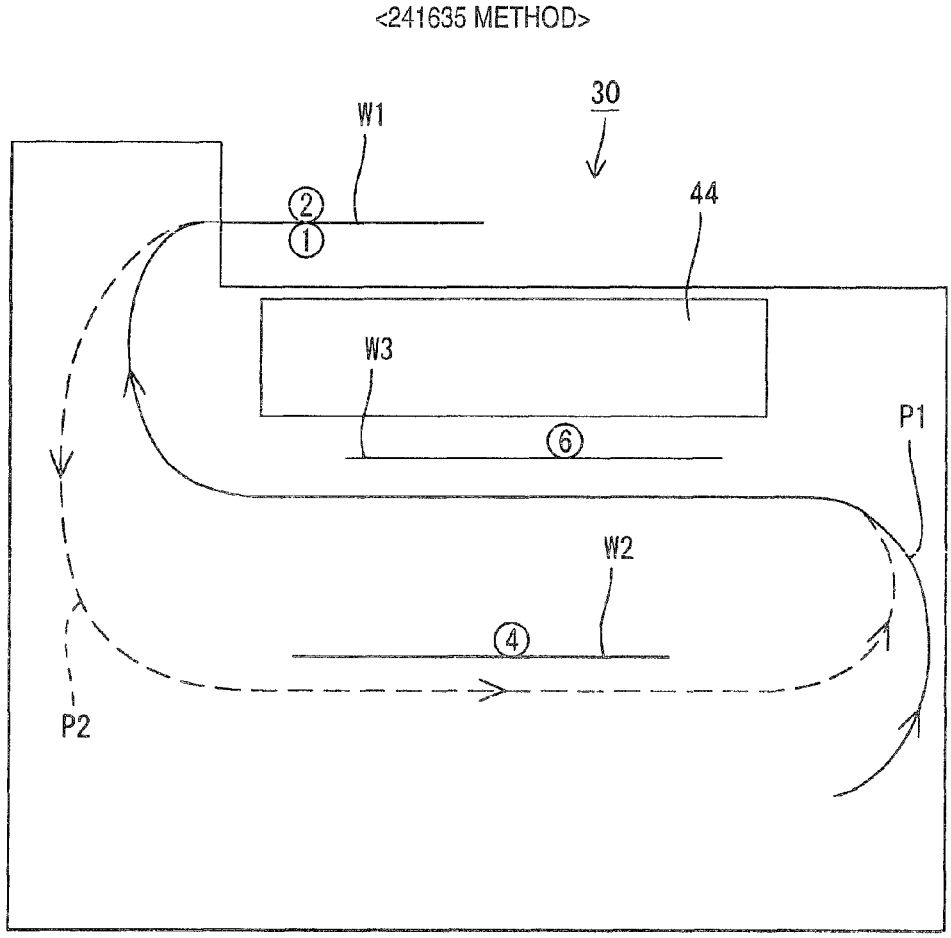
FIG. 5A is a diagram schematically illustrating a 241635 method.
Figure 5B:
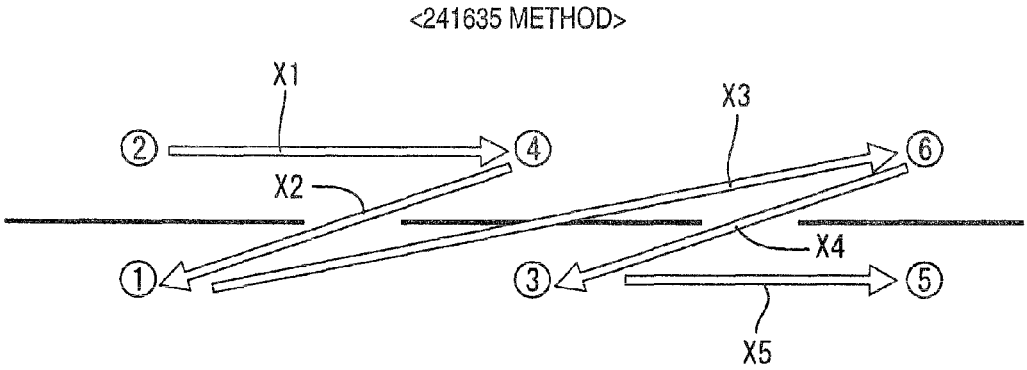
FIG. 5B is a diagram illustrating a printing sequence in the 241635 method.

FIGS. 3A to 5A are diagrams schematically illustrating methods of performing the double-side printing process and FIGS. 3B to 5B are diagrams illustrating printing sequences of the methods. In the drawings, marks of numbers surrounded with a circle are added to the sheet W. The marks mean images of the pages, the numbers mean the page numbers, and the positions of the marks on the sheets W mean the surfaces (front surface or back surface) of the sheet W having the image of the corresponding page formed thereon. The white arrows and reference signs in FIGS. 3B, 4B, and 5B represent the printing sequence.

The printer 30 can perform a double-side printing operation including an operation of printing images on one side of N (where N is 1 or greater) non-printed sheets (sheets W in which images are printed on both sides thereof) and then printing images on the opposite side of M (where M is equal to or less than N) one-side printed sheets (sheets W in which an image is printed only on one side thereof).

Hereinafter, N is referred to as "the number of one-side printed sheets N" and M is referred to as "the number of opposite-side printed sheets M". The printer 30 can selectively perform plural double-side printing methods in which at least one of the number of one-side printed sheets N and the number of opposite-side printed sheets M is different.

These methods are classified depending on whether the method is an infinite loop system or a finite loop system and depending on the greatness of the number of one-side printed sheets N. The "finite loop system" is a method of repeatedly performing an operation (finite loop) of printing images on the back side of the N one-side printed sheets W and then printing images on the front side of N one-side printed sheets W. On the other hand, the "infinite loop system" is a method of printing images on the back side of N one-side printed sheets W and then inserting the printing of images on the back side of a new non-printed sheet in the course of printing images on the front side of N one-side printed sheets W. Hereinafter, examples of the methods will be described.

Method in which the number of one-side printed sheets N is 1: 21 method (finite loop system)

Method in which the number of one-side printed sheets N is 2: 2413 method (finite loop system), 241635 method (infinite loop system)

Method in which the number of one-side printed sheets N is 3: 246135 method (finite loop system), 246183579 method (infinite loop system)

The "21 method" is a method (double-side continuous printing method) of a continuous back-side printing operation and a front-side printing operation on each of W1 sheets uniformly from the start of the printing to the end of the printing, where the number of one-side printed sheets N is "1" and the number of opposite-side printed sheets M is "1". For example, when images of 6 pages are printed on both sides of three sheets W, the printer 30 performs a printing operation in the following order (see FIG. 3B).

Second-page image (back side of first sheet W1)
First-page image (front side of first sheet W1)
Fourth-page image (back side of second sheet W2)
Third-page image (front side of second sheet W2)
Sixth-page image (back side of third sheet W3)
Fifth-page image (front side of third sheet W3)

As shown in FIG. 3A, until printing the first-page image on the front side of the first sheet W1 after printing the second-page image on the back side of the first sheet W1, the printing operation is not performed on the second or subsequent sheet W.

The "2413 method" is a finite loop system in which an operation of printing images on the back sides of two sheets W and then printing images on the front sides of the two sheets W is repeatedly performed, where the number of one-side printed sheets N is "2" and the number of opposite-side printed sheets M is "2". For example, when images of 6 pages are printed on both sides of three sheets W, the printer 30 performs a printing operation in the following order (see FIG. 4B).

Second-page image (back side of first sheet W1)
Fourth-page image (back side of second sheet W2)
First-page image (front side of first sheet W1)
Third-page image (front side of second sheet W2)
Sixth-page image (back side of third sheet W3)
Fifth-page image (front side of third sheet W3)

As shown in FIG. 4A, only after the third-page image is printed on the front side of the second sheet W2, the sixth-page image is printed on the back side of the third sheet W3.

The "241635 method" is an infinite loop system in which images are printed on the back sides of two sheets W and then an image is printed on the back side of a new non-printed sheet at the time of printing an image on the front side of one sheet W thereof, where the number of one-side printed sheets N is "2" and the number of opposite-side printed sheets M is "1". For example, when images of 6 pages are printed on both sides of three sheets W, the printer 30 performs a printing operation in the following order (see FIG. 5B).

Second-page image (back side of first sheet W1)
Fourth-page image (back side of second sheet W2)

First-page image (front side of first sheet W1)

Sixth-page image (back side of third sheet W3)

Third-page image (front side of second sheet W2)

Fifth-page image (front side of third sheet W3)

As shown in FIG. 5A, after printing the first-page image on the front side of the first sheet W1 and before printing the third-page image on the front side of the second sheet W2, the sixth-page image is printed on the back side of the third sheet W3.

4. Printing Control Process

A printing control process carried out in the image forming system 1 will be divided into a process of the terminal device 10 and a process of the printer 30 for description.

4-1. Process of Terminal Device

When a user activates application software for treating documents or images by the use of the operation unit 15 to input a print request, the CPU 11 reads the printer driver from the hard disk drive 14 and displays a print setting picture (not shown) for setting printing conditions such as sheet size, image quality, monochrome/color, and one-side printing/double-side printing on the display unit 16. The user can select and set one of plural double-side printing methods in the setting picture.

When the user sets the printing conditions in the print setting picture and performs a predetermined fixing operation, the CPU 11 transmits print data (for example, PDL data) and a variety of print setting information (including the double-side printing method) set in the print setting picture to the printer 30.

4-2. Process of Printer

When receiving the print data and the print setting information from the terminal device 10, the CPU 31 of the printer 30 stores the print data and the information, for example, in the RAM 33 or the hard disk drive 34 (non-volatile memory) (the RAM 33 or the like is an example of the storage unit). Then the CPU analyzes the print setting information and determines which of the one-side printing and the double-side printing is specified. When the one-side printing is specified, the CPU causes the print unit 37 to perform a normal one-side printing operation. On the other hand, when the double-side printing is specified, the CPU causes the print unit to perform a double-side printing process to be described later.

Figure 6:
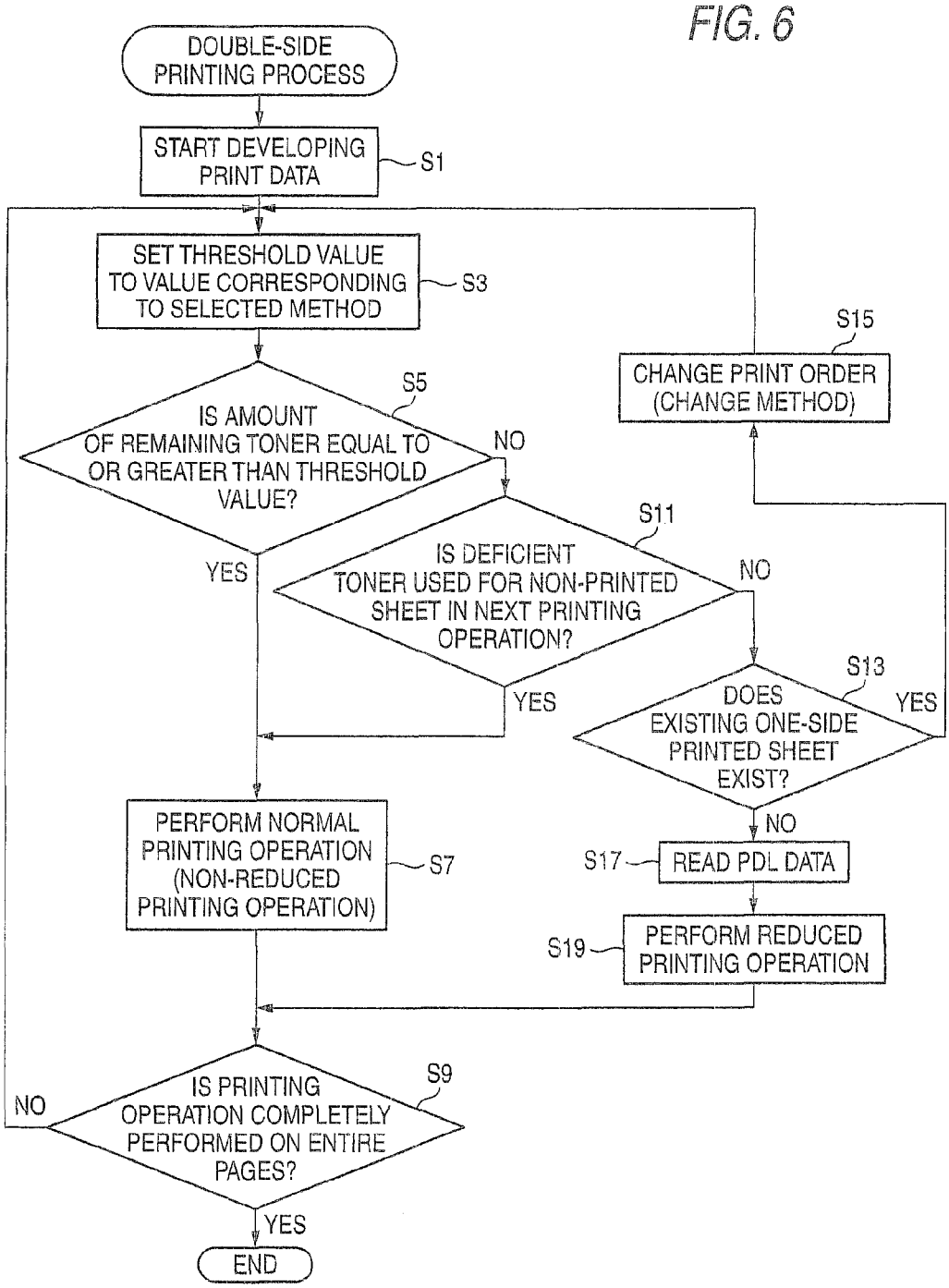
FIG. 6 is a flowchart illustrating a double-side printing process.

FIG. 6 is a flowchart illustrating the double-side process. It is assumed that the print data includes image data of plural pages. The printer 30 can suppress the generation of an unsuitable sheet in which images having different tones are printed on one side and the opposite side thereof due to the lack of a toner, by performing the double-side printing process. The double-side printing process will be specifically described below.

First, the CPU 31 first reads the print data from the RAM 33 or the like and starts a process of developing the image data included in the print data into bit-map data in the page order depending on the printing conditions (S1). Then, the CPU reads the selected double-side printing method from the printing conditions and changes the threshold value to be used for determining the amount of remaining toner to a value corresponding to the one-side printed sheets N in the method (S3). Specifically, the threshold value is set to the value of the amount of remaining toner necessary for printing a one-page image×the number of one-side printed sheets N×2 (both sides).

Subsequently, the CPU determines whether the amount of remaining toner is equal to or greater than a first threshold value for every process cartridge 51 (S5). At this time, the CPU 31 serves as the "determination unit".

When an affirmative determination that the amount of remaining toner is equal to or greater than the threshold value is made for all the process cartridges 51 (YES in S5), a normal printing operation (non-reduced printing operation) based on the image data of one page is performed on the sheet W using the selected method (S7). When the image data of a page not printed remains (NO in S9), the process of S3 is performed again. When the image data of all the pages is printed (YES in S9), the double-side printing process is ended.

On the other hand, when a negative determination (hereinafter, the toner on which the negative determination is made is referred to as "deficient toner") that the amount of toner remaining in at least one process cartridge 51 is less than the threshold value is made (NO in S9), the CPU 31 determines whether the next printing operation should be performed on the existing one-side printed sheet, which is being conveyed by the conveyance mechanism 43 at the time of first making the negative determination in S5 (S11). For example, it is determined on the basis of the printing order in the currently-performed method whether the next printing operation is performed for an even-page image. When the next printing operation is performed for an odd-page image, it is determined that the next printing operation is performed on the existing one-side printed sheet.

(1) Case where Next Printing is Performed on Existing One-Side Printed Sheet

When the next printing operation is performed on the existing one-side printed sheet (YES in S11), the print unit 37 is controlled to perform the normal printing operation on the front side of the existing one-side printed sheet in S7. Here, an image has been printed on the front side of the existing one-side printed sheet by the normal printing operation. Accordingly, when the reduced printing operation with the reduced amount of the lack toner is performed on the front side of the one-side printed sheet, the above-mentioned improper sheet is generated. Therefore, when the affirmative determination is made in S11, the normal printing operation is performed.

For example, when the currently-selected method is the "2413 method" and the first negative determination is made in any one period of X2, X3, and X5 in FIG. 4B in S5, the next printing operation is performed on the front side of the existing one-side printed sheet (W1, W2, and W3). Accordingly, as for the next printing operation, the normal printing operation is performed in the printing order corresponding to the 2413 method. Therefore, the sheets W1, W2, and W3 can be made to proper sheets having the same tone on both sides thereof.

When the currently-selected method is the "241635 method" and the first negative determination is made in any one period of X2, X4, and X5 in FIG. 5B in S5, the next printing operation is performed on the front side of the existing one-side printed sheet (W1, W2, and W3). Accordingly, as the next printing operation, the normal printing operation is performed in the printing order corresponding to the 241635 method. Therefore, the sheets W1, W2, and W3 can be made to proper sheets having the same tone on both sides thereof.

(2) Case where Next Printing is Performed on Non-Printed Sheet

When the next printing operation is performed on a non-printed sheet (NO in S11), it is determined whether an existing one-side printed sheet exists (S13). As an example of this determination method, the determination is made on the basis of the printing order in the currently-selected method. Sheet detecting sensors (for example, a registration sensor denoted by reference numeral 70 and indicated by a two-dot chained line in FIG. 2) may be disposed in the vicinity of the printing conveyance path P1 and the inverting conveyance path P2 and the determination may be made on the basis of a detection signal from the sensors 70.

When it is determined that the existing one-side printed sheet does not exist (NO in S13), the CPU reads the print data from the RAM 33 or the like again (S17) and performs the reduced printing operation on a non-printed sheet using the currently-selected method on the basis of the print data (S19). It is possible to suppress the use of the deficient toner by the reduced printing operation. The reduced printing operation includes, for example, the following patterns. The user may determine what thereof should be carried out, for example, at the time of setting the printing conditions. At the time of performing the reduced printing operation, a picture for selecting the patterns may be displayed on the display unit 36 of the printer 30 and one may be determined by the user's selection.

(1) Deficient toner using pattern: This is a pattern using a deficient toner and the used amount thereof is reduced. For example, color image data corresponding to a deficient toner out of the print data is developed again into the bit-map data with the printing condition that the concentration is lower than that of the original image. A method of thinning out dots from the bit-map data or a method of lowering the exposure intensity of the exposure device 52 can be used to lower the concentration. When the next printing operation also uses a toner (hereinafter, referred to as "non-deficient toner") other than the deficient toner, the concentration of the non-deficient toner may be lowered to be equivalent to that of the deficient toner.

(2) Deficient toner replacing pattern: This is a pattern using a non-deficient toner instead of a deficient toner. For example, the color image data corresponding to the deficient toner out of the print data is developed into the bit-map data again with the printing condition that the color of the deficient toner is replaced with the color of the non-deficient toner. More specifically, when the next printing operation is to print a color image and the deficient toner is at least one of chromatic color (yellow, magenta, and cyan) toners, all the chromatic color toners are replaced with the achromatic color (black) toner to print a black-and-white image. When the next printing operation is to print a black-and-white image and the deficient toner is the achromatic color toner, the achromatic color toner is replaced with one of the chromatic color toners to perform the printing operation.

For example, when the currently-selected method is the "2413 method" and the first negative determination is made in the period of X4 in FIG. 4B in S5, the next printing operation is performed on the back side of the third sheet W3 as a non-printed sheet and no existing one-side printed sheet exists. Accordingly, the sixth-page image is printed on the back side of the third sheet W by the reduced printing operation. In the subsequent printing, the third sheet W is the one-side printed sheet, but is not the existing one-side printed sheet at the time of first making the negative determination in S5 (NO in S11 and NO in S13). Accordingly, the fifth-page image is printed on the front side of the third sheet W by the reduced printing operation. As a result, both the front and back sides of the non-printed sheet after the first negative determination is made thereon in S5 are subjected to the reduced printed operation and thus the non-printed sheet becomes a proper sheet having the same tone on both sides.

When it is determined in S13 that an existing one-side printed sheet exists (YES in S13), the printing order is changed (S15) and the normal printing operation on the existing one-side printed sheet is performed prior to the reduced printing operation on the non-printed sheet. Specifically, The currently-selected method is changed to a method satisfying at least one of a condition that the number of one-side printed sheets N is smaller and a condition that the number of opposite-side printed sheets M is greater than that when the affirmative determination is made.

For example, when the currently-selected method is the "2413 method" and the first negative determination is made in the period of X1 in FIG. 4B in S5, the next printing operation is performed on the back side of the second sheet W2 as a non-printed sheet and the first sheet W1 exists as the existing one-side printed sheet. Accordingly, the currently-selected 2413 method is changed to the "21 method" in which the number of one-side printed sheets N is smaller (S15), and the threshold value is changed to a value corresponding to the 21 method in S3.

When the amount of remaining toner is equal to or greater than the changed threshold value (YES in S5), the first-page image is printed on the front side of the first sheet W1 by the normal printing operation (S7). On the other hand, when the amount of remaining toner is less than the changed threshold value (NO in S5), the next printing operation is changed to the printing on the first sheet W1 as the existing one-side printed sheet by changing the method (YES in S11). Accordingly, the first-page image is printed on the front side of the first sheet W1 by the normal printing operation (S7). As a result, the first sheet W1 can be made to a proper sheet.

For example, when the currently-selected method is the "241635 method" and the first negative determination is made in any one period of X1 and X3 in FIG. 5B in S5, the next printing operation is performed on the back side of the second sheet W2 (or the third sheet W3) as a non-printed sheet and the first sheet W1 (or the second sheet W2) exists as the existing one-side printed sheet. Accordingly, the currently-selected 241635 method is changed to the "2413 method" in which the number of opposite-side printed sheets M is greater (S15), and the threshold value is changed to a value corresponding to the 2413 method in S3.

When the amount of remaining toner is equal to or greater than the changed threshold value (YES in S5), the first-page image (or the third-page image) is printed on the front side of the first sheet W1 (or the second sheet W2) by the normal printing operation (S7). On the other hand, when the amount of remaining toner is less than the changed threshold value (NO in S5), the next printing operation is changed to the printing on the first sheet W1 (or the second sheet W2) as the existing one-side printed sheet by changing the method (YES in S11). Accordingly, the first-page image (or the third-page image) is printed on the front side of the first sheet W1 (or the second sheet W2) by the normal printing operation (S7). As a result, the first sheet W1 (or the second sheet W2) can be made to a proper sheet.

5. Advantages

According to this embodiment, the printer 30 can perform the reduced printing operation with the reduced amount of deficient toner when the negative determination that the amount of remaining toner is less than the threshold value. However, when the negative determination is made, the reduced printing operation is not performed on the opposite side of the existing one-side printed sheet generated already, but the reduced printing operation is performed on one side of a new non-printed sheet. Accordingly, it is possible to suppress an unsuitable sheet having different tones on one side and the opposite side thereof from being generated.

When the deficient toner using pattern is used in the reduced printing operation, the used amount of non-deficient toner used in the printing as well as the used amount of the deficient toner is reduced. Accordingly, the printing result can be made to approach the original tone of the image printed with a proper amount of toner before the toner is deficient.

When the deficient toner replacing pattern is used in the reduced printing operation, the deficient toner is not used, thereby satisfactorily suppressing an unsuitable sheet from being generated. When the chromatic color toner is deficient, a color image can be printed as a black-and-white image (achromatic image) with which a user can be easily familiar.

The threshold value is changed to a value corresponding to the number of one-side printed sheets N in the currently-selected method. According to this configuration, when the currently-selected method is a finite loop system, the images corresponding to at least one finite loop can be printed using the deficient toner even after the negative determination that the amount of remaining toner is less than the threshold value is made, thereby preventing the generation of an incomplete sheet. In the infinite loop system, it is also possible to prevent the generation of an incomplete sheet more effectively.

At the time of performing the reduced printing operation, the bit-map data to be used for the reduced printing operation can be generated from the existing bit-map data, but the processing load therefor may increase. On the contrary, according to this embodiment, even when the print data is first developed, the print data is stored in advance in the RAM 33 or the like, and the development process into the bit-map data with the printing condition corresponding to the reduced printing operation is performed again on the basis of the print data. Accordingly, it is possible to easily embody the reduced printing operation by only changing the printing condition (changing the command).

When the negative determination that the amount of remaining toner is less than the threshold value, the normal printing operation can be continuously performed before and after the negative determination is made, by performing the normal printing operation using the changed method prior to the reduced printing operation, thereby suppressing the double-side printing process from being complicated. For example, when a color printing is changed to a black-and-white printing, special operations of separating the process cartridge 51 of a chromatic color toner from the belt 48 or cleaning the photosensitive member 53 can be performed. In this configuration, when the pattern in which a color printing is changed to a black-and-white printing is used in the reduced printing operation, it is possible to reduce the number of special operations in comparison with the case where the reduced printing operation is performed with priority, by performing the normal printing operation with the priority.

Other Embodiments

The invention is not limited to the above-mentioned embodiment described with reference to the drawings, but, for example, the following aspects are included in the technical scope of the invention. Particularly, out of elements of the embodiments, the elements other than the essential elements of the invention are accessory and can thus be omitted properly.

(1) A user selects the double-side printing method in the above-mentioned embodiment, but the invention is not limited to this configuration. For example, the CPU 11 or the CPU 31 may automatically select the double-side printing method depending on the amount of remaining toner.

(2) The LED-type printer 30 is exemplified as the image forming apparatus in the above-mentioned embodiment, but the invention is not limited to this configuration. Another electrophotographic type image forming apparatus such as a polygon mirror type may be employed and an inkjet type image forming apparatus may be employed. Color ink other than four colors may be employed and a monochromatic (for example, black and white) printer may be employed.

(3) The amount of remaining toner is directly sensed by the sensor 65 in the above-mentioned embodiment, but the invention is not limited to this configuration. For example, the amount of remaining toner may be predicted on the basis of the number of printed sheets, the number of revolutions of the photosensitive member or the developing roller, and the like at the time of replacing the process cartridge with a new one. In this configuration, the sensor 65 is not necessary.

(4) The example where a user inputs a print request or sets the printing conditions by the use of the terminal device 10 is described in the above-mentioned embodiment, but the invention is not limited to this configuration. For example, print data may be stored in the hard disk driver 34 of the printer 30 or an external memory and the double-side printing process may be performed by causing the user to input a request for performing the double-side printing process based on the print data by the use of the operation unit 35.

(5) In the above-mentioned embodiment, when the next printing operation in the reduced printing uses a deficient toner and a non-deficient toner, the used amount of only the deficient toner may be reduced or the deficient toner may not be used in the next printing operation.

(6) An example where an infinite loop system is changed to a finite loop system in S15 of the double-side printing process and an example where a finite loop system is changed to a finite loop system in which the number of one-side printed sheets N is smaller than that in the finite loop system are described in the above-mentioned embodiment, but the invention is not limited to this configuration. An infinite loop system may be changed to an infinite loop system with the smaller number of one-side printed sheets N and/or the greater number of opposite-side printed sheets M.

What is claimed is:

1. An image forming apparatus comprising:

a print unit which includes a container containing a colorant and performs a double-side printing operation including an operation of printing images on one side of N non-printed sheets ($N \geqq 1$) and then printing images on the opposite side of M one-side printed sheets ($M \leqq N$) using the colorant;

a determination unit which determines whether an amount of the colorant remaining in the container is equal to or greater than a threshold value; and a control unit which causes the print unit to perform a reduced printing operation with a reduced amount of colorant when the determination unit determines that the amount of the remaining colorant is less than the threshold value, wherein the control unit performs the reduced printing operation on one side of a new non-printed sheet instead of performing the reduced printing operation on the opposite side of a one-side printed sheet existing at the time that the determination unit determines that the amount of the remaining colorant is less than the threshold value.

2. The image forming apparatus according to claim 1, wherein the control unit controls the print unit to perform the reduced printing operation on both sides of the new non-printed sheet.

3. The image forming apparatus according to claim 1, wherein the print unit includes a plurality of the containers containing the colorants of different colors and can perform a printing operation using the colorants in the plurality of containers, the determination unit determines whether the amount of the remaining colorant in each container is equal to or greater than the threshold value, and when the determination unit determines for any colorant that the amount of the remaining colorant is less than the threshold value, the control unit controls the print unit to reduce a used amount of the colorant on which the determination unit determines that the amount of the remaining colorant is less than the threshold value and reduce a used amount of the colorant on which the determination unit determines that the amount of the remaining colorant is equal to or greater than the threshold value.

4. The image forming apparatus according to claim 1, wherein the print unit includes a plurality of the containers containing the colorants of different colors and can perform a printing operation using the colorants in the plurality of containers, the determination unit determines whether the amount of the remaining colorant in each container is equal to or greater than the threshold value, and when an image to be printed includes the color of the colorant on which the determination unit determines that the amount of the remaining colorant is less than the threshold value and the color of the colorant on which the determination unit determines that the amount of the remaining colorant is equal to or greater than the threshold value, the control unit controls the print unit to perform a printing operation without using the colorant on which the determination unit determines that the amount of the remaining colorant is less than the threshold value at the time of performing the reduced printing operation.

5. The image forming apparatus according to claim 1, wherein the print unit includes a plurality of the containers containing the colorants of different colors and can perform a printing operation using the colorants in the plurality of containers, the determination unit determines whether the amount of the remaining colorant in each container is equal to or greater than the threshold value, and the control unit controls the print unit to perform a printing operation using the colorant on which the determination unit determines that the amount of the remaining colorant is equal to or greater than the threshold value instead of the colorant on which the determination unit determines that the amount of the remaining colorant is less than the threshold value at the time of performing the reduced printing operation.

6. The image forming apparatus according to claim 5, wherein the plurality of colorants include a chromatic colorant and an achromatic colorant, and when the determination unit determines for the chromatic colorant that the amount of the remaining colorant is less than the threshold value, the control unit controls the print unit to print an image including a chromatic color using the achromatic colorant at the time of performing the reduced printing operation.

7. The image forming apparatus according to claim 1, wherein the control unit controls the print unit to selectively perform a plurality of double-side printing methods in which at least one of N and M is different, and the determination unit sets the threshold value to be greater as the number of one-side printed sheets N in the currently-selected double printing operation becomes greater.

8. The image forming apparatus according to claim 1, wherein the control unit controls the print unit to selectively perform a plurality of double-side printing methods in which at least one of N and M is different, and when the determination unit determines that the amount of the remaining colorant is less than the threshold value, the control unit controls the print unit to perform a non-reduced printing operation in priority to the reduced printing operation using a method satisfying at least one condition of a condition that N is smaller than that when the determination unit determines that the amount of the remaining colorant is equal to or greater than the threshold value and a condition that M is greater than that when the determination unit determines that the amount of the remaining colorant is equal to or greater than the threshold value.

9. The image forming apparatus according to claim 1, further comprising a storage unit storing print data, wherein the control unit develops the print data to generate bit-map data and to give the bit-map data to the print unit, and wherein the control unit generates the bit-map data to be used for the reduced printing operation on the basis of the print data stored in the storage unit when the determination unit determines that the amount of the remaining colorant is less than the threshold value.

10. An image forming system comprising:

a conveyance mechanism conveying a non-printed sheet;

a print unit which includes a container containing a colorant and performs a double-side printing operation including an operation of printing images on one side of N non-printed sheets ($N \geqq 1$) and then printing images on the opposite side of M one-side printed sheets ($M \leqq N$) using the colorant;

a determination unit which determines whether an amount of the colorant remaining in the container is equal to or greater than a threshold value; and a control unit which causes the print unit to perform a reduced printing operation with a reduced amount of colorant when the determination unit determines that the amount of the remaining colorant is less than the threshold value, wherein the control unit performs the reduced printing operation on one side of a new non-printed sheet instead of performing the reduced printing operation on the opposite side of a one-side printed sheet existing at the time that the determination unit determines that the amount of the remaining colorant is less than the threshold value.

11. A computer readable storage device storing a program controlling an image forming apparatus which includes a print unit which includes a container containing a colorant and performs a double-side printing operation including an operation of printing images on one side of N non-printed sheets ($N \geqq 1$) and then printing images on the opposite side of M one-side printed sheets ($M \leqq N$) using the colorant, the program causing the image forming apparatus to perform:

determining whether an amount of the colorant remaining in the container is equal to or greater than a threshold value; and causing the print unit to perform a reduced printing operation with a reduced amount of colorant when it is determined that the amount of the remaining colorant is less than the threshold value in such a manner that the reduced printing operation is performed on one side of a new non-printed sheet instead of performing the reduced printing operation on the opposite side of a one-side printed sheet existing at the time that it is determined that the amount of the remaining colorant is less than the threshold value.

12. An image forming apparatus comprising:

a print unit which includes a container containing a colorant and performs a double-side printing operation using the colorant, the double-side printing operation including an operation of printing images on a first side of a sheet and then printing images on a second side of the sheet;

a determination unit which determines whether an amount of the colorant remaining in the container is equal to or greater than a threshold value; and a control unit which causes the print unit to perform a normal printing operation and a reduced printing operation using an amount of colorant smaller than that of the normal printing operation, wherein when the determination unit determines that the amount of the remaining colorant is equal to or greater than the threshold value, the control unit causes the print unit to perform the normal printing operation, wherein when the determination unit determines that the amount of the remaining colorant is less than the threshold value, the control unit performs the reduced printing operation on a first side of a new non-printed sheet, wherein if the determination unit determines that the amount of the remaining colorant is less than the threshold value, the control unit performs the normal printing operation on the second side of a sheet whose first side is printed in the normal printing operation, and wherein if the determination unit determines that the amount of the remaining colorant is less than the threshold value, the control unit performs the reduced printing operation on one side of a second side of the sheet whose first side is printed in the reduced printing operation.

* * * * *